United States Patent [19]

Rullo

[11] Patent Number: 4,875,550

[45] Date of Patent: Oct. 24, 1989

[54] GAFF

[75] Inventor: James J. Rullo, Elmira, N.Y.

[73] Assignee: Buckingham Manufacturing Company, Inc., Binghamton, N.Y.

[21] Appl. No.: 283,683

[22] Filed: Dec. 13, 1988

[51] Int. Cl.[4] ..... A63B 27/00

[52] U.S. Cl. ..... 182/221; 182/134

[58] Field of Search ..... 182/221, 134; 248/216.1; 36/113, 136

[56] References Cited

U.S. PATENT DOCUMENTS

| | | | |
|---|---|---|---|
| 1,981,755 | 11/1934 | Serene | 182/221 |
| 4,574,919 | 3/1986 | Clay | 182/221 |
| 4,679,658 | 7/1987 | Demers | 182/221 |

*Primary Examiner*—Reinaldo P. Machado

*Attorney, Agent, or Firm*—Salzman & Levy

[57] ABSTRACT

The invention features a gaff for use in combination with a leg iron for climbing trees and poles.

The gaff has alternating relief and expansion surfaces for decompressing and compressing wood as the gaff penetrates therein, thus easing the penetration into the wood.

14 Claims, 1 Drawing Sheet

GAFF

FIELD OF THE INVENTION

This invention relates to a gaff for use in combination with a leg iron for climbing poles or trees, and more particularly to a gaff that will more easily penetrate the pole or tree material.

BACKGROUND OF THE INVENTION

In recent times, utility poles have been impregnated with preservatives in order to improve their durability.

However, such preservatives have also rendered the poles harder and more resistant to the penetration of gaffs. As a result, linemen have found it increasingly more difficult and dangerous to climb these impregnated poles.

A new gaff was designed to improve the penetration into these poles, as described and illustrated in U.S. Pat. No. 4,679,658; issued: July 14, 1987.

The new gaff design featured a prism shaped gaff having teeth running along one surface and a number of grooves running along the other two sides of the prism body.

This gaff had both teeth and grooves disposed along the gaff body in order to abrade the wood upon penetration. It was believed that the abrasive action of these combined teeth and grooved surfaces assisted the point of the gaff to further penetrate the wood.

While the aforementioned patented gaff improved the ability to penetrate hard wood, the theory and effectiveness of the gaff was not well understood, and was believed to be in need of further improvement.

It has now been discovered that the teeth actually add frictional resistance to the advancement of the gaff into the wood, and therefore, it is better to keep the top surface of the gaff smooth.

In addition, it has also been discovered that a better method of penetrating the wood lies in relieving the compression of the wood upon initiated penetration and then following the decompression of wood with alternating compressive, decompressive and compressive forces.

A gaff designed to practice this method is described hereinafter.

SUMMARY OF THE INVENTION

The invention features a gaff for use with, and attachment to a leg iron. The gaff has a forward body section for penetrating the wood, and a rearward body section for attaching the gaff to the leg iron.

The forward penetrating section includes in sequential order a point of penetration followed by a concave relief section, thereafter followed by a convex expansion section, a second relief section and a final expansion section comprising the remaining surface of the forward penetrating section.

The aforesaid design allows for alternating compressive and decompressive forces to be exerted in the wood as the gaff penetrates, thus facilitating the ease by which the gaff is caused to enter the pole or tree.

It is an object of this invention to provide an improved gaff for penetrating a pole or a tree.

It is another object of the invention to provide a gaff for use with a pole or tree climber, which will more easily penetrate the wood of the pole or tree.

These and other objects of this invention will become more apparent and will be better understood with reference to the following detailed description considered in conjunction with the accompanying drawings.

DETAILED DESCRIPTION OF THE INVENTION

Generally speaking, the invention pertains to a gaff that more easily penetrates the wood of a pole or tree, when used in combination with a leg iron.

For purposes of brevity, like components will bear the same designation throughout the specification.

Figure 1:
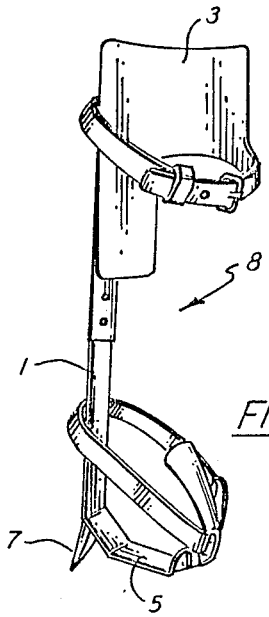
FIG. 1 is the gaff of the invention shown in situ with a leg iron.

Now referring to FIG. 1, the gaff 7 of this invention is attached to a leg iron 1 of a climber's apparatus, depicted by arrow 8. Stirrup 5 of apparatus 8 is used to support the boot or shoe of the lineman while pad 3 is secured to the upper tibia portion of the lineman's leg.

Figure 3:
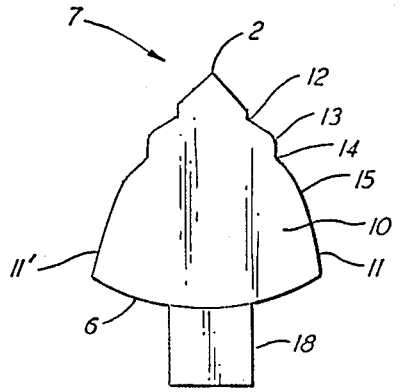
FIG. 3 is a front view of the penetrating section of the gaff shown in FIG. 2*a* viewed along lines A—A'.
Figure 2A:
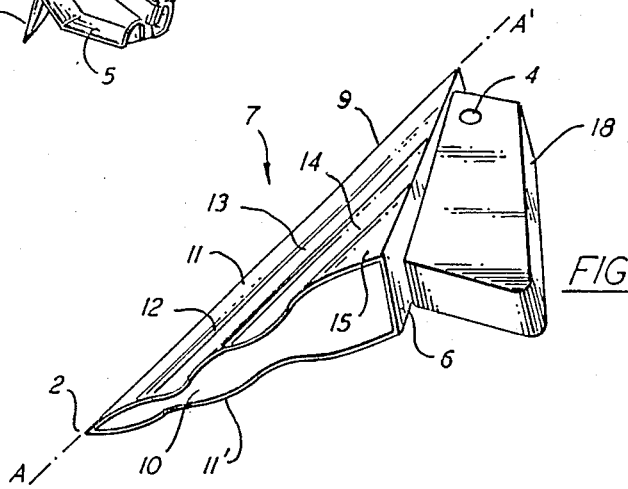
FIG. 2*a* is a perspective view of the removable gaff of the invention.
Figure 4:
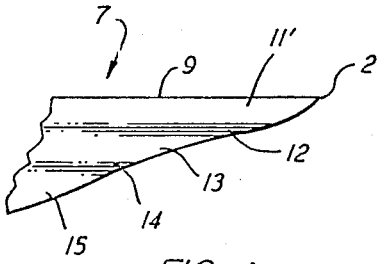
FIG. 4 is a side view of the penetrating section of the gaff shown in FIG. 2*a*.

The gaff 7 of this invention is shown in more detail with reference to FIGS. 2–4. The gaff 7 comprises a prismatic-shaped penetrating section defined by three sides 10, 11 and 11'. Surface 10 is the smooth bottom surface of gaff 7, and sides 11 and 11' are identical side surfaces having a common ridge line 9 at the top of the gaff where they intersect each other.

In the preferred embodiment (FIG. 2*a*) a rear surface 6 includes a wedge-shaped support or lug 18 that attaches the gaff 7 to leg iron 1 by means of a pin (not shown) that is hammered into hole 4. The pin can be removed in order to remove gaff 7 from leg iron 1. It should be understood that other means well known in the art, for removably attaching gaff 7 to leg iron 1 can also be implemented within the scope of the present invention.

Figure 2B:
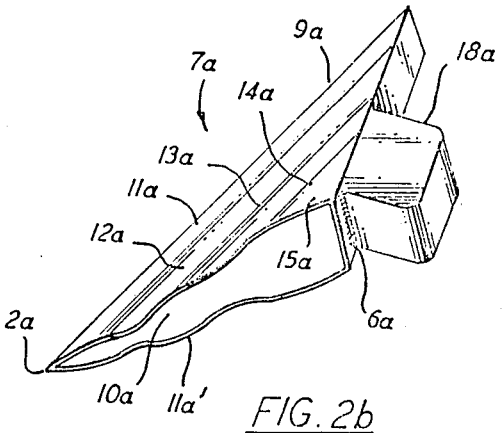
FIG. 2*b* is a perspective view of an alternate embodiment of the gaff for permanent attachment.

Alternatively, a gaff adapted for permanent attachment to a leg iron is shown in FIG. 2*b*. The structure of permanent gaff 7*a* is similar to that of removable gaff 7 (FIG. 2*a*), but lug 18*a* does not include a hole for mounting, nor does it extend substantially along the entire length of rear surface 6*a*. Permanent gaff 7*a* can be secured to leg iron 1 by peening, welding or other suitable means.

Surfaces 11 and 11' (FIG. 2*a*) are identical and define in sequential order from the point of penetration 2, alternating relief and expansion surfaces 12, 13, 14 and 15, respectively. Relief surfaces 12 and 14 are respectively defined by concave recesses, and expansion surfaces 13 and 15 are respectively defined by convex protuberances.

The penetration point 2 compresses the wood as the forward section of the gaff 7 initially penetrates the pole or tree. Next, the wood meets the relief surface 12 which allows the compressed wood to decompress. Compression, decompression and compression follow the initial penetration by virtue of surfaces 13, 14 and 15, respectively.

The alternating pattern of compression and decompression has been found by extensive testing to improve greatly the penetration of the gaff 7 into the pole or tree.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented by the subsequently appended claims.

What is claimed is:

1. A gaff for use with, and attachment to, a leg iron, that is characterized by improved penetration into pole or tree materials, said gaff comprising:

a gaff body having a forward penetrating section and a rearward section for attaching said body to said leg iron, said forward penetrating section including in sequential order, a means defining a point of penetration followed by a first relief section, thereafter followed by a first expansion section, followed by a second relief section, said point of penetration and said expansion section causing a compression in the pole or tree materials during the penetration of said gaff body into said pole or tree materials, and said subsequent relief sections allowing said compressed materials to decompress as said gaff body continues to penetrate the pole or tree.

2. The gaff of claim 1, wherein said gaff body includes three penetrating surfaces, and further wherein one of said three surfaces is substantially smooth.

3. The gaff of claim 1, wherein said gaff body includes three surfaces, and further wherein two of said surfaces include and define said first expansion section and said first and second relief sections, respectively.

4. The gaff of claim 2, wherein two of said surfaces other than said substantially smooth surface include and define said first expansion section, and said first and second relief sections, respectively.

5. The gaff of claim 1, further comprising a second expansion section following said second relief section.

6. The gaff of claim 3, wherein said two surfaces further include and define a second expansion section following said second relief section, said second expansion section comprising a greater surface area than said first expansion section.

7. The gaff of claim 4, wherein said two surfaces further include and define a second expansion section following said second relief section, said second expansion section comprising a greater surface area than said first expansion section.

8. The gaff of claim 2, wherein said three surfaces form a prismatic structure.

9. The gaff of claim 1, wherein said first and second relief sections respectively comprise a concave recess in said gaff body.

10. The gaff of claim 1, wherein said first expansion section comprises a convex portion of said gaff body.

11. The gaff of claim 5, wherein said first and said second expansion sections each comprise convex portions of said gaff body.

12. A gaff for use with, and attachment to a leg iron, characterized by improved penetration into pole or tree materials, said gaff comprising a substantially prismatic body terminating on one end in a point for initially penetrating said body into said pole or tree, said point followed by a first concave recess defining a relief section, followed further by a first convex expansion section and a second concave relief recess.

13. The gaff of claim 12, further comprising a second convex expansion section following said second concave relief recess.

14. A gaff in combination with a leg iron, comprising a body section terminating in a point for initially penetrating and compressing a pole or tree material, said point followed by a first concave groove defining a relief section, said relief section followed by a convex protuberance defining a first expansion section, said relief and expansion sections respectively allowing said pole or tree material to decompress and then recompress the material of said pole or tree as said body further penetrates said pole or tree material, whereby said gaff penetration is easily facilitated.

* * * * *